US005256218A

United States Patent [19]

Bakalyar et al.

[11] Patent Number: 5,256,218

[45] Date of Patent: Oct. 26, 1993

[54] FORMING OF INTERMETALLIC MATERIALS WITH CONVENTIONAL SHEET METAL EQUIPMENT

[75] Inventors: Allen D. Bakalyar, El Segundo; Peter Lydia, Inglewood, both of Calif.

[73] Assignee: Rockwell International Corporation, Seal Beach, Calif.

[21] Appl. No.: 770,252

[22] Filed: Oct. 3, 1991

[51] Int. Cl.[5] ..... C22C 14/00

[52] U.S. Cl. ..... 148/670; 148/421; 148/669; 148/671

[58] Field of Search ..... 148/669, 670, 671, 421

[56] References Cited

U.S. PATENT DOCUMENTS

| | | | |
|---|---|---|---|
| 4,661,316 | 4/1987 | Hashimoto et al. | 420/418 |
| 4,726,852 | 2/1988 | Nakasone et al. | 148/670 |
| 5,028,277 | 7/1991 | Mizoguchi et al. | 428/660 |

FOREIGN PATENT DOCUMENTS 0171862 7/1988 Japan .

*Primary Examiner*—Uprendra Roy

*Attorney, Agent, or Firm*—Terrell P. Lewis; Charles T. Silberberg

[57] ABSTRACT

A method and apparatus for applying heat sufficient to permit plastic deformation of intermetallic material. The heat is applied to a fractional region of a workpiece, and then manipulations capable of causing the workpiece to deform are applied using conventional sheet metal forming equipment. The invention utilizes elevated forming temperatures to heat the fractional region of the intermetallic workpiece so that the fractional region has sufficient ductility to permit a plastic deformation required for the forming operation. The apparatus is a sheet metal-working machine which has been modified to provide the localized heating required to carry out the process of the present invention.

11 Claims, 2 Drawing Sheets

FORMING OF INTERMETALLIC MATERIALS WITH CONVENTIONAL SHEET METAL EQUIPMENT

BACKGROUND OF THE INVENTION

1. Field of the Invention

The present invention relates to methods for forming titanium alloy materials, and more particularly to a method of forming titanium aluminide materials using conventional sheet metal equipment and tooling to fabricate structural components, and localized heating of the workpiece alone.

2. Background of the Invention

In the family of intermetallic metals, titanium aluminide materials have become most useful in the design of structures requiring a high strength-to-weight ratio. Although unique in the class of titanium alloy compositions, titanium aluminide materials may, like the more typical titanium alloys, contain additions of one or more alloying agents such as tin, zirconium, molybdenum, vanadium, silicon, chromium, manganese and iron. Titanium aluminide materials find particular application in the field of aircraft and spacecraft design.

While several important end uses exist for titanium aluminide materials, there still remain various difficulties in effecting deformation of these materials to achieve a final, desired useful shape. The most frequently encountered obstacle is the inability to manipulate these materials, for it has become well-known that titanium aluminides are relatively brittle and not amenable to forming with conventional techniques at or near room temperatures.

One recent approach which has found widespread utility in the fashioning of structural components from such materials is superplastic forming, a process in which a superplastic material (e.g., a titanium or aluminum alloy) is heated to a forming temperature, generally in the range of from about 1700° F. to about 1900° F., and then formed in a die using positive or negative pressure on one side of the metal to force the metal to plastically "flow" against or into the die.

Although the advantages of superplastic forming are numerous, the process has drawbacks. For one thing, it requires special equipment including a controlled environment within the heating and forming apparatus, the application of very high forming temperatures (on the order of about 1700° F. to about 1900° F.), and specially designed tools for handling the materials and equipment while heated and before they are fully cooled. Additionally, the heating and cooling phases of the process take place over extended periods of time and require uniquely designed tool supports having appropriate thermal coefficients to accomodate the high forming temperatures. For these reasons, as well as the fact that this process requires thermal treatment of not only the whole workpiece, but also the heating and forming apparatus, efforts have been made to discover alternative techniques and/or equipment to achieve the same or similar end results, while reducing cost and time involved and increasing efficiency.

OBJECTS AND SUMMARY OF THE INVENTION

It is therefore an object of the present invention to provide a novel method of forming structure out of intermetallic materials, such as titanium alloys, which facilitates the use of conventional sheet metal forming equipment while overcoming all the deficiencies and disadvantages of other forming methods of like kind.

Another object of the present invention is to provide a novel forming method for fabricating a structural member from a workpiece of intermetallic material, where localized heating of a predetermined portion of the workpiece to be formed is employed to overcome the brittle behavior of the material at room temperature.

Still another object of the invention is to provide an apparatus which permits practice of the novel method of this invention, including applying heat to a predetermined region of the workpiece in advance of causing a desired deformation of that predetermined region by conventional sheet metal forming equipment.

These and other objects are accomplished according to the teachings of the present invention in which heat sufficient to permit plastic deformation of intermetallic material is applied to a fractional region of a workpiece of such material, and then manipulations capable of causing the workpiece to deform are applied using conventional sheet metal forming equipment. The invention utilizes elevated forming temperatures to heat the fractional region of the intermetallic workpiece so that the fractional region has sufficient ductility to permit a plastic deformation required for the forming operation.

DETAILED DESCRIPTION OF THE INVENTION

The present invention comprises a method of forming intermetallic titanium alloy materials at elevated temperatures, and contemplates the use of conventional sheet metal equipment, such as press brakes, stretch wrap machines, punch presses, joggling presses, etc., as well as conventional tooling, to fabricate structural components. The process includes the application of heat to a small, fractional region of a workpiece to a temperature at which the material possesses sufficient ductility to undergo the desired deformation. Temperatures in the range of 400° F. to 600° F. have been experimentally demonstrated for the alpha-2 ($Ti_3Al$) family of titanium aluminide alloys. The heat is applied using heat-applying apparatus which is secured to the conventional forming equipment. The invention contemplates modification of the conventional forming equipment so that the heat-applying apparatus can be moved into and out of accessibility with the fractional region of the workpiece about to be deformed. The present invention contemplates application of heat to just the fractional region of the workpiece to be manipulated. The process of this invention, therefore, does not require heating of the forming tools.

Figure 1:
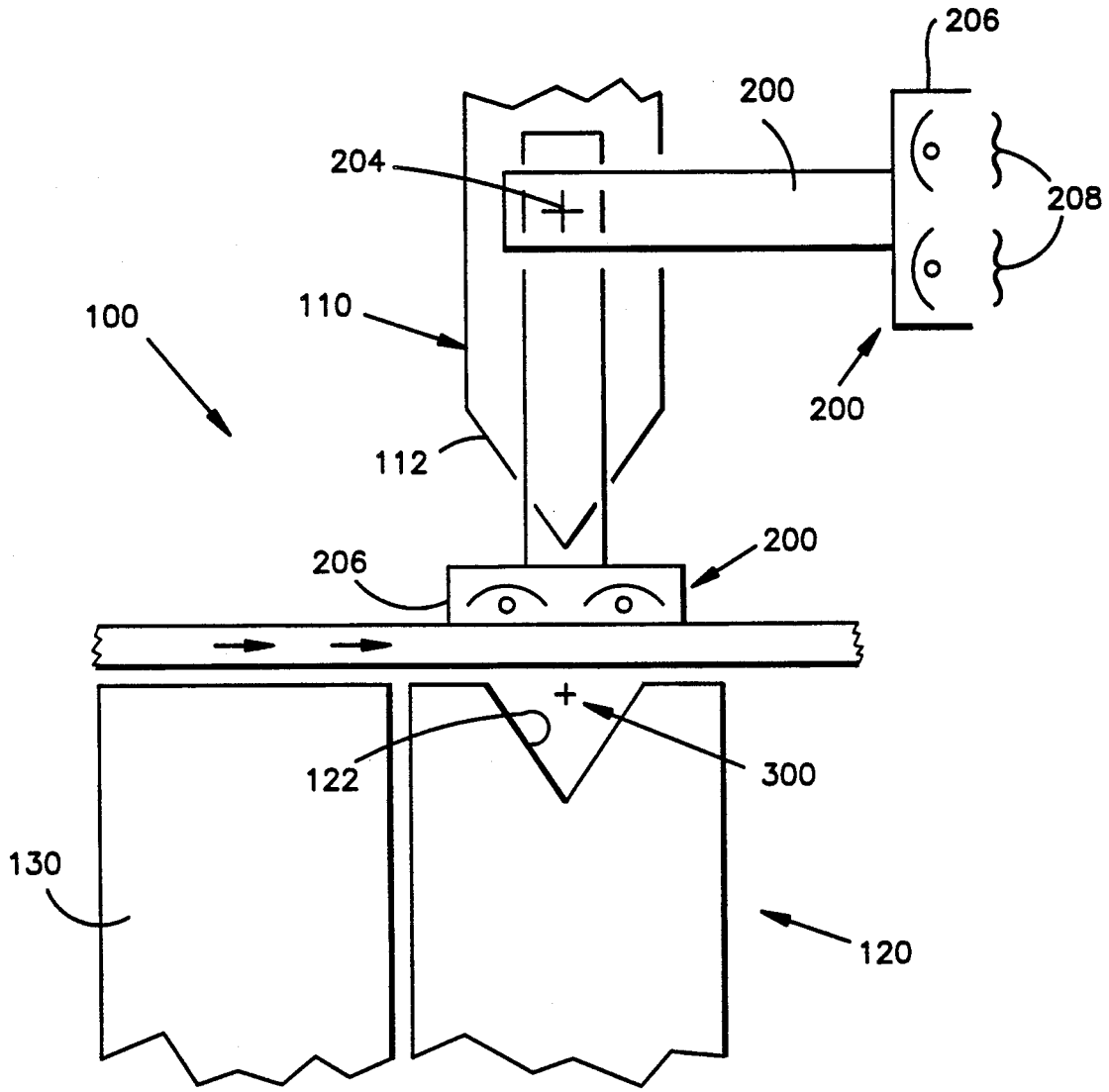
FIG. 1 schematically illustrates a press brake forming machine which has been modified to include heating apparatus required to carry out the heating step of the method of the present invention.

FIG. 1 illustrates one embodiment of a conventional sheet metal machine commonly known as a press brake, in which the machine has been modified to provide the localized heating capability required to carry out the process of the present invention.

As shown, the press brake machine 100 comprises an upper, vertically movable, press brake die 110 and a lower, fixed, press brake die 120. The upper and lower dies are vertically aligned so that the convex forming face 112 of the upper die overlies the concave forming face 122 of the lower die. Typically, the convex forming face of the the upper die will conform in topographical shape to the concave forming face of the lower die. Attached to the upper press brake die is a heater assembly 200 which includes a supporting arm 202 pivotably mounted on the upper die at pivot 204 for movement between a first position in which the arm is substantially vertically arranged and a second position in which the arm is substantially horizontally arranged. A heater 206 is carried at the end of the arm located opposite the pivotably mounted end. A plurality of quartz lamp heating elements 208 are attached within the casing of the heater 206. A thermocouple 300 is positioned below the workpiece in a location relative to the lower die (e.g., as seen in FIG. 1, substantially centrally of the concave lower die forming face 122).

In carrying out the method according to the present invention, a workpiece in the form of a sheet of titanium aluminide material is placed on a supporting bed 130 located just upstream of the press brake lower die 120, and is fed in a forward direction past the lower die. At each predetermined location where the sheet of metal is to be deformed by bending between the upper and the lower dies, that predetermined location of the sheet is positioned atop the concave forming face of the lower die. The heater assembly is then pivoted downwardly from its second position to the first position so that the heater 206 is positioned directly atop the sheet's predetermined location. The heating elements are then actuated for a period of time to attain a predetermined temperature appropriate for the deformation to take place, the thickness of the material to be shaped, and the physical properties which the final product is intended to possess. After this predetermined temperature has been achieved, the heating elements are deactivated and the heater assembly is pivoted out of its first position back to the second position so that the now-heated region of the sheet at the predetermined location can be deformed using the upper and lower dies of the press brake (i.e., by lowering the upper die toward the lower die and into deforming engagement with heated region of the sheet). The sheet is then advanced in the forward direction a distance which corresponds to the location where the next deformation of the sheet is to be imparted using this press brake machine.

Figure 2:
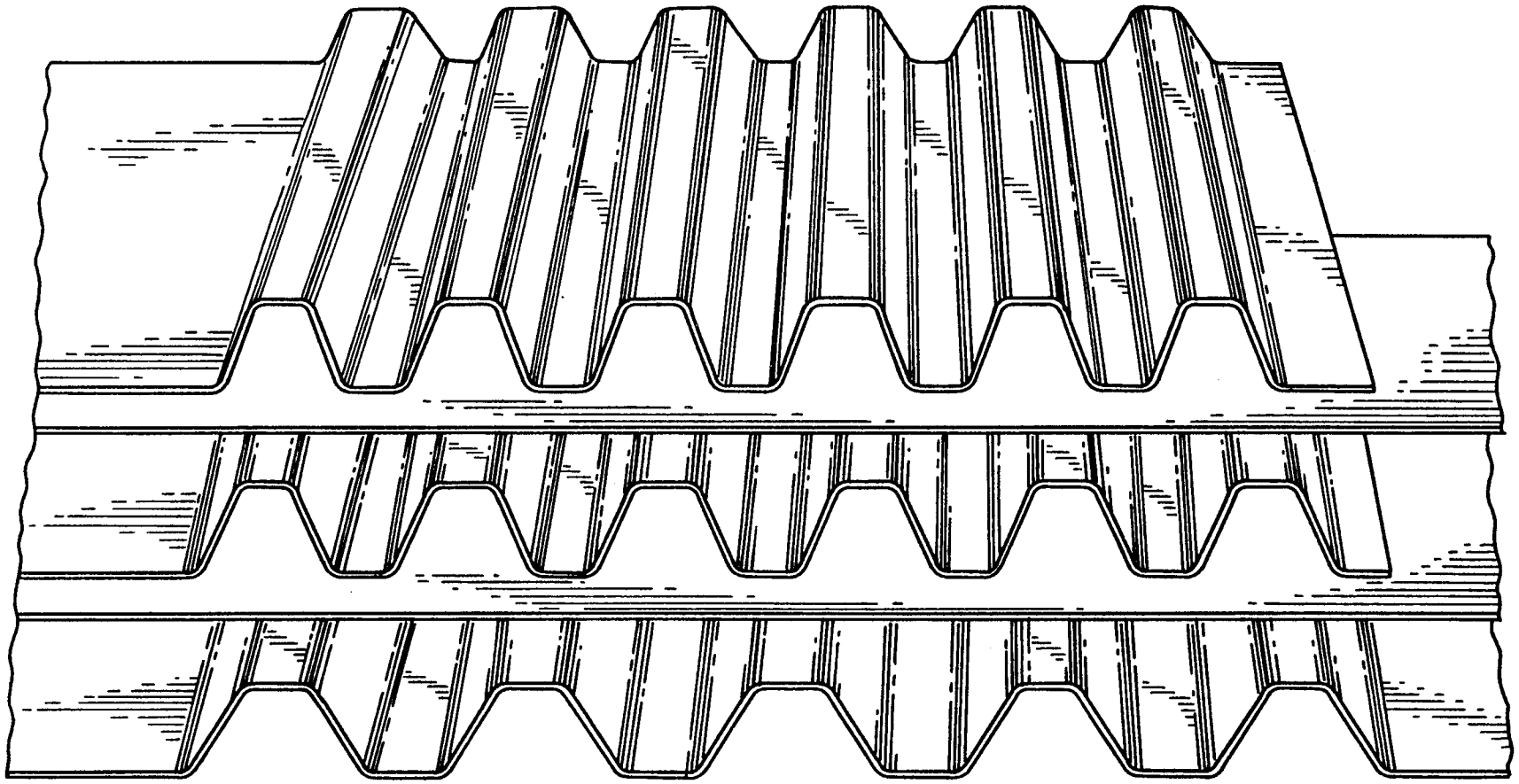
FIG. 2 illustrates the formed intermetallic workpiece following the teachings of the method of the present invention.

The steps of this process are repeated until the sheet presents the desired shape(s). An example of one structural element obtained following steps of the inventive process similar to those described above is shown in FIG. 2.

The invention contemplates performing the steps of the entire process manually as well as by automated machinery. In the latter case, one or more machines could be controlled by computer hardware and software which would facilitate forming several sheets of intermetallic material simultaneously, each on its own machine.

While certain representative embodiments and details have been shown for the purpose of illustrating the invention, it will be apparent to those skilled in this art that various changes and modifications may be made therein without departing from the spirit or scope of this invention.

What we claim is:

1. A method for transforming a substantially planar sheet of titanium aluminide material into a structural component using a press brake machine, comprising:

locating one region of said sheet material where deforming is to take place, heating said one region at said location at a temperature of no more than 600° F. for a predetermined period of time, and deforming said heated region into a desired shape by pressing an upper die associated with said press brake machine against said region and toward a lower die associated with said press brake machine, whereby the substantially planar sheet of material is transformed into a non-planar structural component.

2. The method of claim 1, where said step of locating comprises defining all of said regions of said sheet where deforming is to take place, and then performing each of said further steps of said process sequentially at each of said defined regions, whereby a plurality of deformations are imparted to said sheet of material to cause said sheet to be transformed into a corrugated structural component.

3. The method of claim 1, wherein said step of applying a predetermined amount of heat to each of said regions comprises moving a heating source between a first position of non-use and a second actuatable position where the heat source is in overlying correspondence with the identified region.

4. A method for transforming a substantially planar sheet of titanium aluminide material into a structural component using a press brake machine, comprising:

locating one region of said sheet material where deforming is to take place, heating said one region at said location at a temperature of between 400° F. and 600° F., deforming said heated region into a desired shape by pressing an upper die associated with said press brake machine against said region and toward a lower die of said machine, locating an other region in said sheet material, and repeating said heating and deforming steps, whereby the substantially planar sheet of material is transformed into a non-planar structural component.

5. The method of claim 4, wherein said one region and said other region are adjacent to one another.

6. The method of claim 4, wherein said step of deforming comprises bending portions disposed on opposite sides of each located region into an angular relationship with said located region.

7. The method of claim 4, wherein said step of locating said other region in said sheet material comprises locating several other regions and sequentially repeating said heating and deforming steps thereafter.

8. The method of claim 7, wherein said step of deforming comprises bending portions disposed on opposite sides of each located region into an anglular relationship with said located region.

9. The method of claim 8, wherein said step of bending comprises forming trough-shaped substructures, at least one of said portions associated with one substructure defining one portion of an adjacent substructure.

10. A method for forming a structural component from a substantially planar sheet of titanium aluminide material using a press brake machine including upper and lower shaping elements, comprising:

arranging said sheet of material relative to said shaping elements of said machine to present a fractional sheet region to said shaping elements of said machine, heating said fractional region to a temperature of between 400° F. and 600° F., moving one of the upper and lower shaping elements of said press brake machine toward the other to impart a non-intrusive bending deformation to said heated, fractional region, and repeating said arranging, heating, and moving steps at least one more times to cause deformation of said sheet of material into a structural component.

11. The method of claim 10, wherein said repeating step comprises performing said arranging, heating and moving steps several times, such that the structural component is a corrugated sheet.

* * * * *